United States Patent [19]

Pitkanen

[11] Patent Number: 4,556,216

[45] Date of Patent: Dec. 3, 1985

[54] COMPUTER DIRECTED EXERCISING APPARATUS

[76] Inventor: Alan R. Pitkanen, 625 Warner Ave., Los Angeles, Calif. 90024

[21] Appl. No.: 523,330

[22] Filed: Aug. 15, 1983

[51] Int. Cl.[4] ..... A63B 17/00

[52] U.S. Cl. ..... 272/126; 272/DIG. 5; 272/134; 273/DIG. 28

[58] Field of Search ..... 272/73, 93, 116, 126, 272/127, 129, 131, 132, 133, 134, 137, 143, 144, 146, DIG. 4, DIG. 5, DIG. 6

[56] References Cited

U.S. PATENT DOCUMENTS 3,848,870 11/1974 Craig ..... 272/DIG. 4

4,112,928 9/1978 Putsch ..... 272/DIG. 6

*Primary Examiner*—Richard C. Pinkham

*Assistant Examiner*—Vincent A. Mosconi

*Attorney, Agent, or Firm*—Keith D. Beecher

[57] ABSTRACT

A mechanical and electronic apparatus which utilizes off-setting positive and negative muscle effort to provide a complete body muscle exerciser. The exerciser is constructed so that left side and right side symmetrical muscle groups are caused to work against one another, with one muscle group moving in extension providing resistance for the symmetrical muscle group to work thereagainst in contraction. A mechanical gear drive train is interposed between the opposing symmetrical muscle groups to transmit the forces exerted thereby, and to guide the user's limbs so that the directions of motion are exactly opposite, and to assure that one muscle group contracts simultaneously with the extension of the other. Electrical sensors are coupled to the mechanical drive train to indicate the resistance being experienced by each muscle group; and also to indicate the position of the muscle groups, that is, the distance they have moved in their excursion. The electrical signals produced by the sensors are processed in a microcomputer which drives appropriate audio and visual displays.

13 Claims, 11 Drawing Figures

COMPUTER DIRECTED EXERCISING APPARATUS

BACKGROUND OF THE INVENTION

Kinesiological research has identified a number of factors that need to be present to provide optimal exercise. Optimal exercise will produce the best physical results the fastest and subsequently require a minimal amount of time to maintain fitness—all important considerations from a user's point of view. The following are the salient factors in optimal muscle exercise:

(1) Dynamically varied resistance—A muscle should be stressed near its maximum throughout its full excursion. Since muscles exert forces on the external world through the skeletal system, and since the mechanical advantage of the muscle/skeletal system is constantly varying as it moves; the external load (resistance) must vary with this motion to stress the muscle fully at each position.

(2) Full Muscle Excursion—It has been determined that full muscle excursion under stress is vitally important to its fitness and development. Stressing a muscle isometrically (i.e. at one position) simply does not produce full muscle fitness. Additionally, considerations of body flexibility and the desire to minimize the potential for muscle rupture dictate full muscle excursion.

(3) Specificity—Exercise routines, and devices involved in them, should address muscles as specifically as possible. This specificity permits the full stressing (1st axiom) of the intended muscle without over or under stressing adjacent or associated muscles. It also permits a focusing or tailoring of the exercise program to meet individual goals.

(4) Rotational Resistance—The human body is a collection of hinged links. Muscles drive these linkages about natural pivots (e.g. elbows, knees), sometimes about a multiplicity of axes (e.g. shoulders). In order to achieve "specificity" it is advantageous to exercise the muscles associated with each hinge point in rotation about that hinge point.

(5) Positive and Negative Work —Both positive (contracting) and negative (extending) muscle work are necessary for optimal muscle development and fitness. Exercise systems which do not load muscles that are extending (e.g. frictional systems) are missing an important half of the exercise cycle.

(6) Pacing—The rate at which an exercise is performed is important depending on the end result that is desired. For cardio-vascular stimulation and fitness exercise, pace should be based on the user's pulse rate.

(7) Individual Routines—Humans differ and the correct exercise routines likewise vary depending upon sex, age, size, condition, and desired results or goals of the fitness program.

The exerciser of the invention, as will become evident as the description proceeds, has been devised particularly to meet all of the criteria set forth above.

Equally important as a properly designed exercise from a physiological point of view is the psychological motivation provided to the user by the exercise routine or system. In the exerciser to be described, the motivational aspects may be provided through electronic/video games and challenges; video/audio instructions, rewards, and encouragements; and personalized electronic bookkeeping of progress toward goals and fitness as measured against past performance levels.

As mentioned above, the exerciser of the invention uses symmetrical muscle groups, working in opposition to one another, to produce safe, effective exercises without working against external weights or other forms of externally imposed resistances. The principle upon which the exerciser of the invention are predicated may be understood by considering a weightlifter. When a weightlifter lifts a single weight with both arms, his two arms do positive, that is contractile, muscle work. Now, when he lowers the weight, in a controlled manner, his two arms do negative, that is extensive, muscle work of an equal but opposite amount. When doing the positive muscle work, the weightlifter puts energy into the weight in the form of potential energy. Then, when doing the negative work, the muscles of the weightlifter absorb energy from the weight equal to the potential energy.

By separating the weight into two equal weights, the same exercise may be performed in the same manner by the weightlifter holding one weight in each arm, and by moving both arms up and down in unison. Moreover, the exercise now can also be performed by raising one arm while the other arm is being lowered, and vice versa. Over one full cycle the amount of positive and negative work performed in both cases is the same.

The exerciser of the present invention is constructed such that the two limbs are moved in a manner described immediately above, with one doing positive muscle work while the other does negative muscle work.

DETAILED DESCRIPTION OF THE ILLUSTRATED EMBODIMENT

Figure 1:
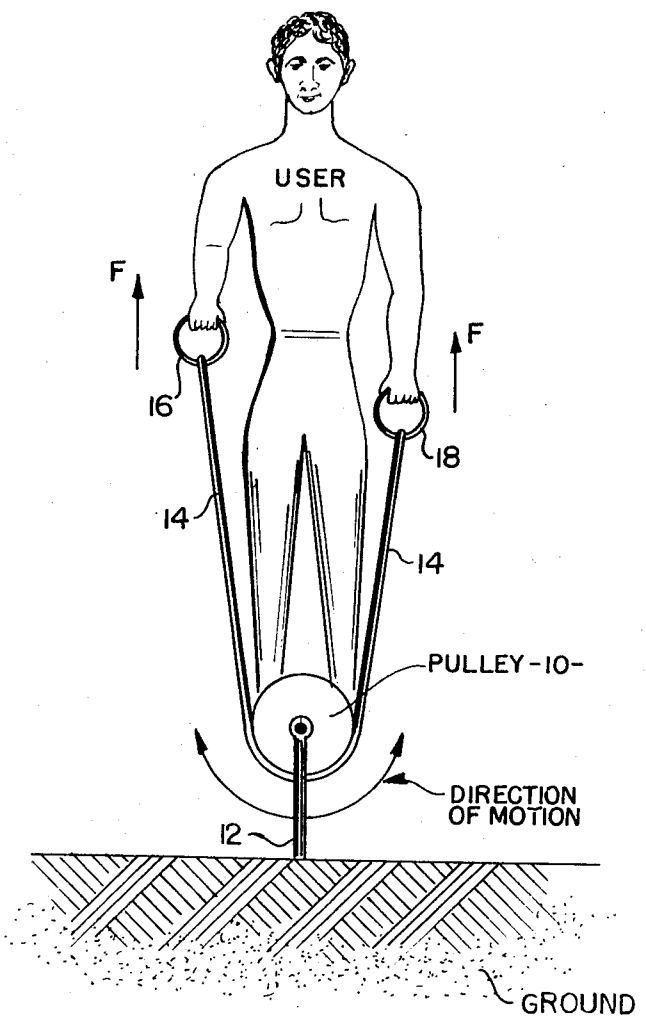
FIG. 1 is a schematic representation illustrating the basic principle on which the exerciser of the invention is predicated.

The device of FIG. 1 includes a pulley 10 which is rotatably mounted on a bracket 12 which is supported on a stationary base designated "ground". A line 14 extends around the pulley, and is equipped with handles 16 and 18 which are grasped by the user.

In the particular device of FIG. 1, the right and left arms of the user are coupled together by line 14 which extends around pulley 10. As the right arm is moved up, the left arm goes down. That is, the arms move in opposite directions. If the left arm resists movement, for example, with a force of ten pounds, the right arm will experience a ten pound resistive load. The resistive force experienced by both arms appears to be externally applied, and it could be derived, for example, from two ten pound weights.

Figure 2:
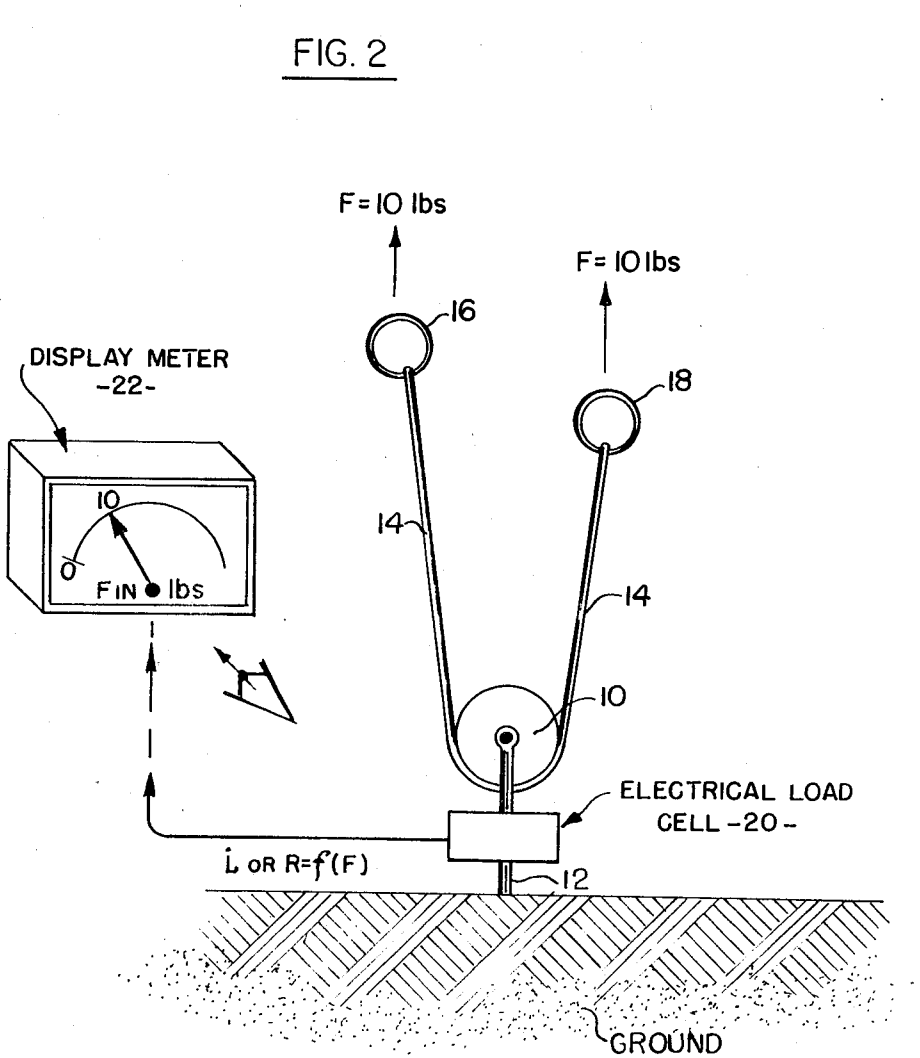
FIG. 2 is a somewhat more detailed schematic representation similar to FIG. 1.

A problem with the simple device of FIG. 1 is that there is no means for indicating that the right arm, for example, is experiencing a ten pound resistive load. However, as shown in FIG. 2, if an electrical load cell 20 is interposed in bracket 12, the cell will produce an electrical signal proportional to the mechanical force exerted on it. If the electrical signal is applied to an appropriate meter 22 which, for example, may be calibrated directly in pounds, the user can perform the same exercise that he previously performed by lifting two identical ten pound weights. This is achieved by the user pulling the line 14 back and forth with sufficient force so that the meter 22 is held at ten pounds.

The simple device of FIG. 2, therefore, provides positive and negative muscle work of symmetrical body muscles with a means to cue the user as to his physical effort. This provides the basis for the "weightless" exercise system of the invention.

Figure 3:
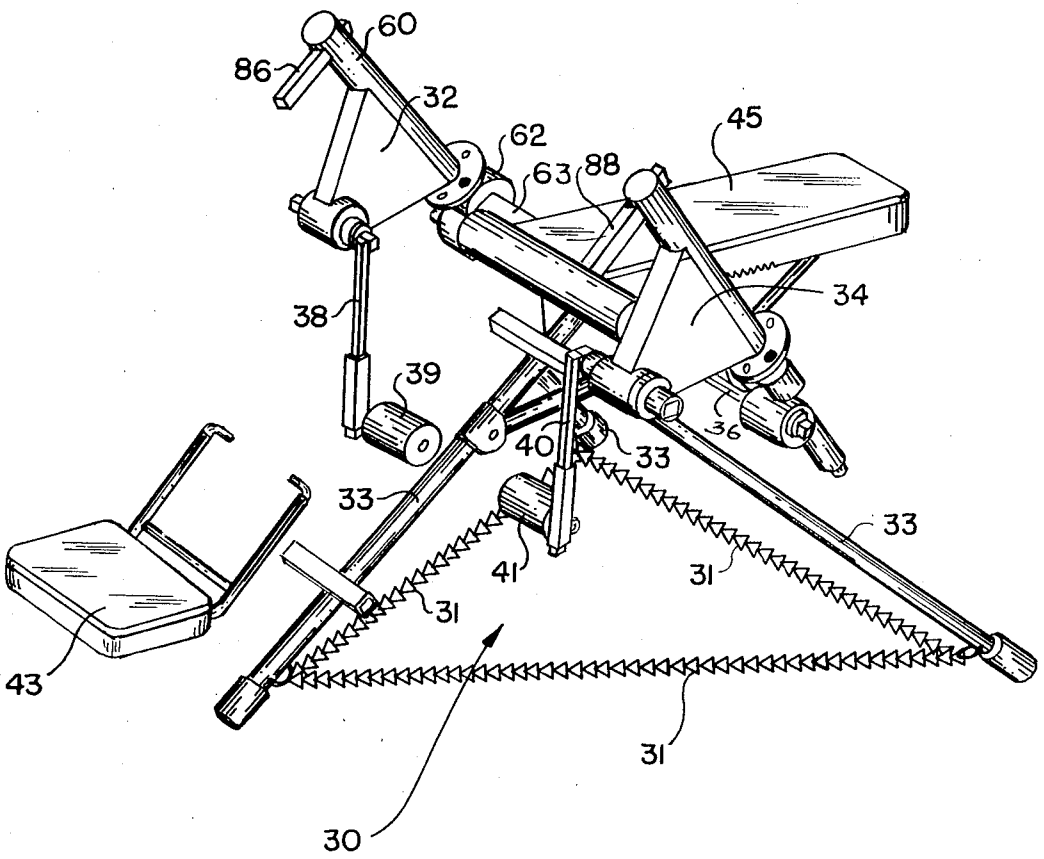
FIG. 3 is a perspective representation of the mechanical portion of the exerciser representing one embodiment of the invention.
Figure 4:
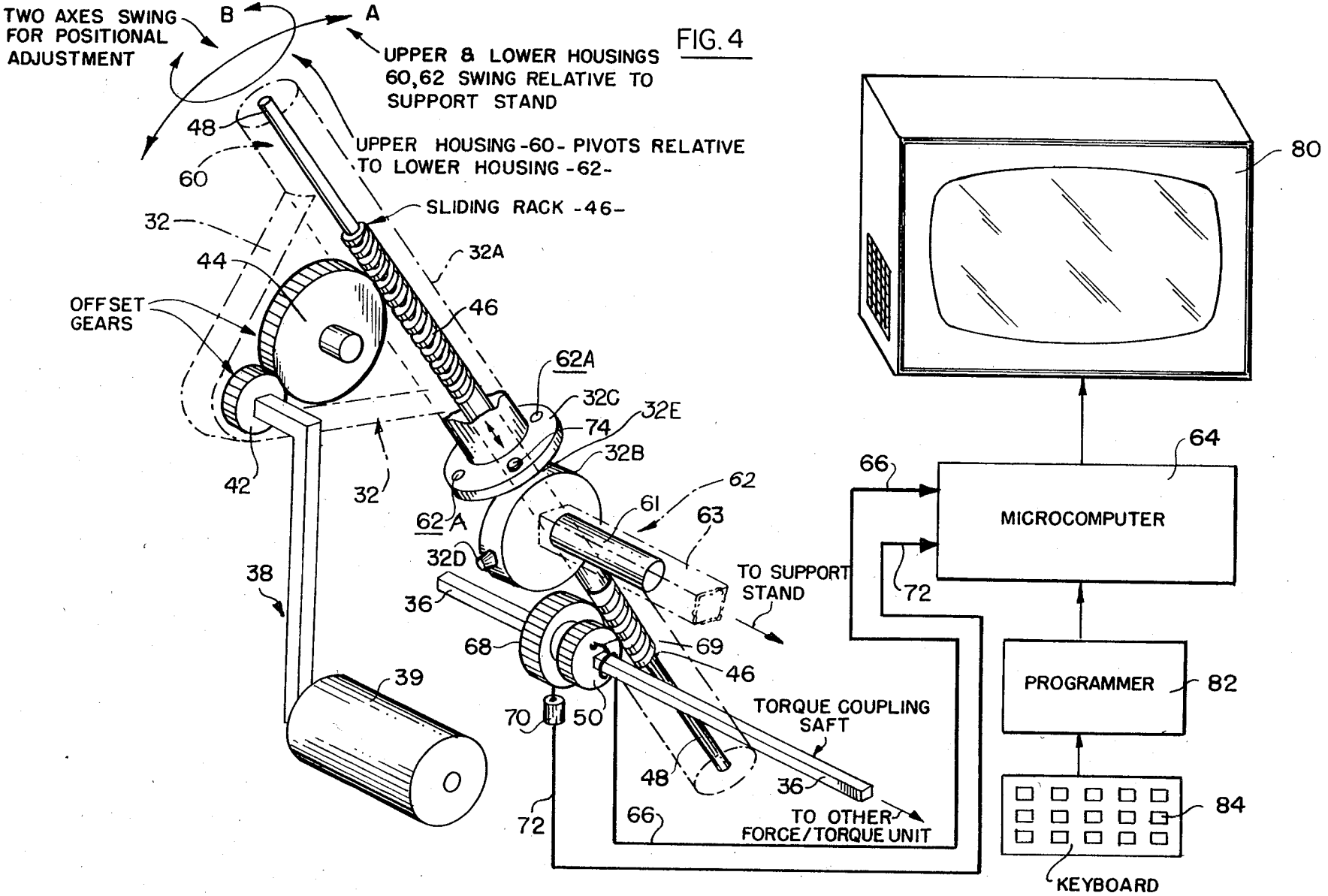
FIG. 4 is a perspective representation of the mechanical portion of the exerciser of FIG. 3, in somewhat more detail, and also illustrating certain electronic components which are included in the overall system.

One form of the exercise apparatus of the invention is shown in FIGS. 3 and 4. The unit shown in FIGS. 3 and 4 includes, for example, a tetrahedral stand 30 which is foldable, so that the unit may be conveniently stored when not in use. The tetrahedral stand 30 is made up of three legs, such as legs designated 33' which are hinged together at the apex of the stand, and three restraining chains 31.

A left force/torque converter assembly 32 is mounted at the apex of the tetrahedral stand 30, and a right force/torque converter assembly 34 is also mounted on the apex of the stand 30. The two force/torque assemblies are interconnected by a rotatable coupling shaft 36. A left crank arm 38 is included in the left force/torque converter assembly 32, and a right crank arm 40 is included in the right force/torque converter assembly 34. A roller 39 is mounted on crank arm 38, and a roller 41 is mounted on crank arm 40. A seat 43 is provided (FIG. 3), and may be detachably mounted on the tetrahedral stand 30, as will be explained. Also, a backrest/bench 45 (FIG. 3) is pivotally mounted on the stand 30, and it may be turned to either of four positions, as also will be described, to form a back rest.

As shown in FIG. 4, the left crank arm 38 is coupled through a pair of gears 42 and 44 to a rack 46. Rack 46 is slidably mounted on a rod 48. Rack 46 serves mechanically to couple the gears 42 and 44 to an output gear 50 for all positions of assembly 32. Gear 50 is spline connected to the drive shaft 36 such that left and right force/torque converter assemblies may be moved horizontally to adapt to varying body widths. The left force/torque converter assembly 32 has an upper housing which includes a tubular portion 32A that receives rod 48 and sliding rack 46 in coaxial relationship. The assembly 32 also includes a disc-shaped lower housing 32B which is mounted in a stub shaft 61. Stub shaft 61 extends coaxially into a shaft 63 that is coaxially secured to the support stand 30. Shaft 61 is rotatable in shaft 63.

The tubular portion 32A of assembly 32 has a flange 32C at its lower end which engages a disc-shaped member 32B in tangential relationship, as shown. Flange 32C has holes 62A. The assembly 32 may be axially raised along rod 48 and positioned over radial locators 32D or 32E on disc-shaped member 32 by rotating it about shaft 63. The assembly 32 may also be rotated axially about rod 48 again positioning one of the holes 62A on locators 32D and 32E.

A pair of latching handles 86 and 88 extend radially from the upper end of the upper housings of the force/-torque converter assemblies 32, 34. The handles enable the user to swing the assemblies 32, 34 about the two axes to desired positions for selected exercises. Latching handles 86 and 88 can be set preventing axial sliding of 32A along 48 thereby firmly positioning 32A relative to 63, and thereby support stand 30.

The tubular portion 32A of the assembly 32, and disc-shaped member 32B, provide a two-axes swing for positional adjustment of the left force/torque converter assembly 32. Specifically, the assembly may be considered to comprise upper and lower housings 60, 62 which may be swung relative to the longitudinal axis of shaft 63 in the direction shown by arrow A in FIG. 4; and the upper housing 60 may be turned relative to the lower housing about the longitudinal axis of rod 48 in the direction represented by arrow B. The upper housing and lower housing 62 may be locked to the support stand at the selected angular position in the manner described above.

A similar mechanism is associated with the right force/torque assembly 34. However, it includes one additional offset gear to give correct directional movement between the crank arms 38 and 40.

A load indicator sensor 69 is interposed between output gear 50 and the drive shaft 36, and the electrical signal from the load indicating electrical sensor 69 is introduced to a microcomputer 64 by way of a lead 66. A further gear 68 key to shaft 36, and a position indicating electrical sensor 70 is coupled to gear 68. Sensor 70 supplies a position indicating electrical signal to the microcomputer 64 over a lead 72.

The microcomputer 64 may be coupled to a television receiver which serves as a display unit, and which provides a video display and an audio output for the system. The microcomputer 64 may be programmed by a typical programmer 82 which includes a keyboard 84.

The electrical signals produced by the sensors 69, 70 are processed in the microcomputer 64, which drives the audio/visual display, such as television receiver 80, or other appropriate audio/visual display. The display is placed in a position so that it can be watched by the exerciser as he is using the apparatus. The exerciser apparatus of the invention is specifically designed so that all exercises are performed with the user facing in the same direction with the body in a position where they can comfortably view the display at all times without moving the display.

The electronic system incorporated in microcomputer 64 generates desired force levels and speeds of motion for particular exercises from its internal memory. The display 80 indicates to the user if he is performing to the desired level of effort, and what needs to be done physically in order to do so. Thus, the electronic system of microcomputer 64 directs and regulates the exercise activity, and the mechanical drive allows the user's own muscles to provide the necessary resistance, without the need for any means of externally imposed resistance such as weights, hydraulics, friction, or pneumatics.

The exerciser apparatus of the invention is devised to involve the user physically and mentally through various exercise games which incorporate psychological reinforcements and incentives. The visual displays provided by unit 80 can challenge; indicate on-target performance; reward or admonish; show progress toward a goal (e.g. time expired, total calories expended); entertain; or give a comparative level of achievement relative to someone else or some standard. This occurs in real time while the exercise is being performed.

In the apparatus of the invention, the physical efforts of the user immediately become electronic signals. These signals may be stored, retrieved, processed, and used to create visual images for the user at appropriate times to provide incentives and motivation. For example, performance curves can be generated to show progress over a period of time. Vivid visual graphics, bar charts and the like, can show the user how far he has come, thereby developing motivation to continue exercising by documenting accomplishment.

Electronic data storage in microcomputer 82 provides the basis of a system for linking diet and exercise. In general it can be said that good physical fitness derives from diet+exercise. This linking is accomplished with a pocket, electronic calorie counter. Several are currently on the market. They list the caloric value of common foods and unusual dishes can be keyed in. In the apparatus of the invention, positive action may be taken regarding the day's caloric intake. The electronic calorie record may be plugged directly into the microcomputer 82, and it automatically sets the adaptive exercise program to account for the daily variations in diet and physical activity of the user. The user thus exercises according to what he eats and does. This direct linking of diet and exercise can cause control in eating and help make exercise a part of daily life.

Data storage and analysis in microcomputer 82 can be the basis for "user to user" competitive games, a form of social interaction. In real time, more than one player can strive for physical goals. It is possible to handicap so that father and son can compete. It is also possible to do this remotely with data transmission links.

It will be appreciated that the assemblies 32 and 34 of the exercising apparatus shown in FIG. 3 be easily and readily moved to a number of angular positions in order to exercise a large number of the body's muscle groups. Additionally, the electronic system (FIG. 4) provides a form of optimal, adaptive exercise which permits the tailoring of exercise routines to individual needs. The mechanical and electronic systems of the apparatus combine to produce an exercise system with advantageous features in regard to exercise physiology, user motivation, adaptability, portability and cost.

The force/torque assemblies 32, 34 receive and transmit at output torques to and from the natural hinge points of the user's body. In all angular positions of the assemblies, the torques have directional senses which cause symmetrical muscles to force against each other and to move oppositely, so that one muscle set is contracting while the other is extending.

The electrical force and position sensors 69, 70 included in the left force/torque assembly 32 provide the necessary electrical signals. The force sensor 69 is located so that all transmitted forces pass through it, and an electrical signal proportional to these forces results. The position sensor 70 provides an electrical signal registering angular rotation of the crank arms 38, 40 from a rest position.

The signals generated by the force and position sensors 69, 70 on leads 66 and 72 are fed to the microcomputer which directs and controls the exercise program. The microcomputer has an internal memory with data to generate a "force versus position" curve for each exercise. This curve has a characteristic profile which holds for all users but which is adjusted up and down in absolute force depending on each user's strength, this being achieved by means of keyboard 84 associated with programmer 82.

The microcomputer 64 compares the input force and position signals from the sensors 69, 70 with the data held in memory and generates an error signal which is fed to display unit 80. The display unit 80 is intended to tell the user how to adjust his efforts to comply with the particular program. The display unit 80 produces a visual display, and it also may provide audio signals. The technology of using the microcomputer to drive displays, such as display 80 is well known to the art and currently used in numerous electronic games presently on the market.

Figure 5:
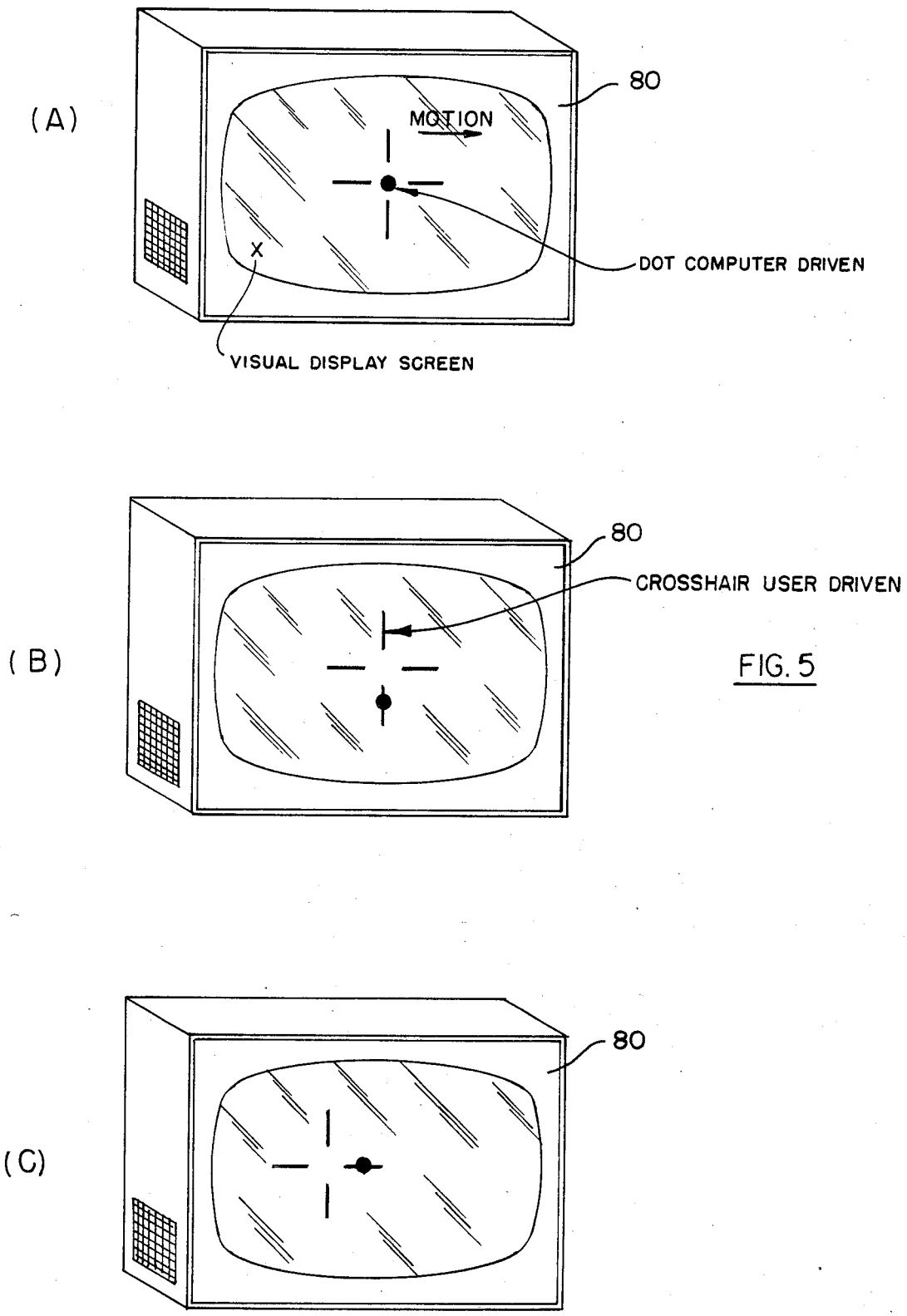
FIG. 5 is a schematic representation of a display which may be used in the practice of the invention in one of its aspects.
Figure 6:
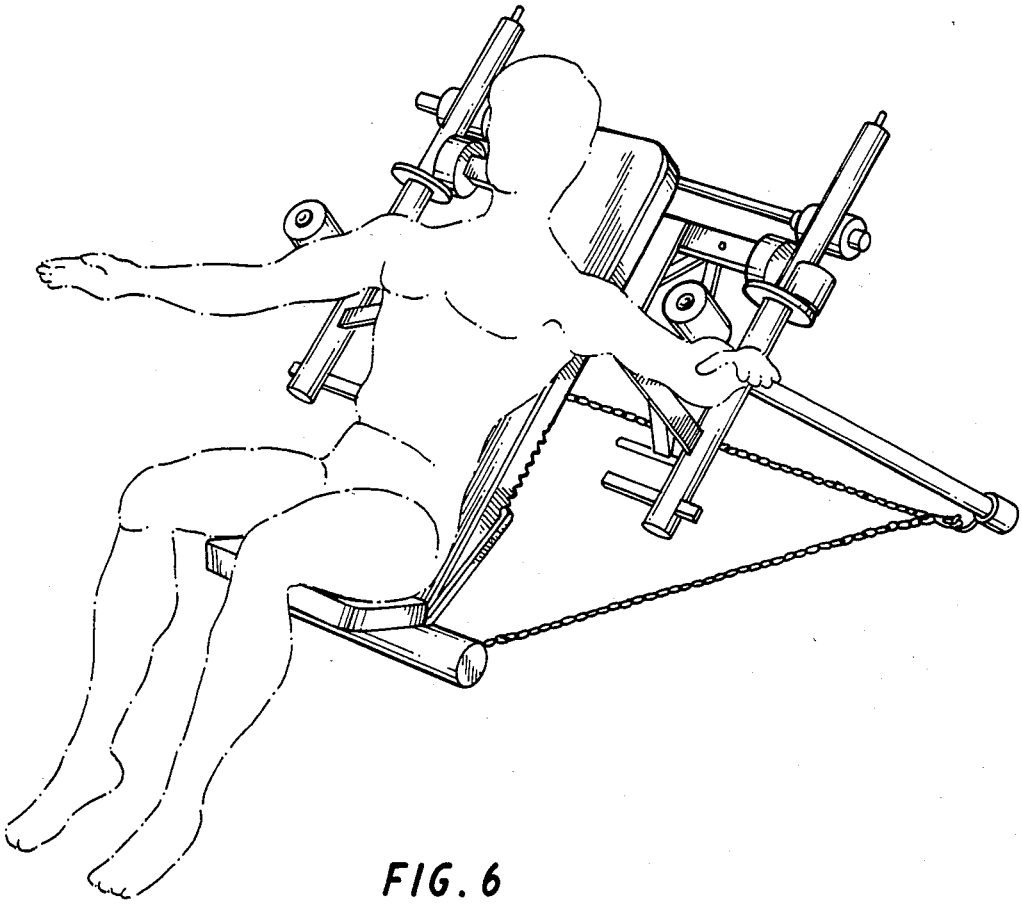
Figure 7:
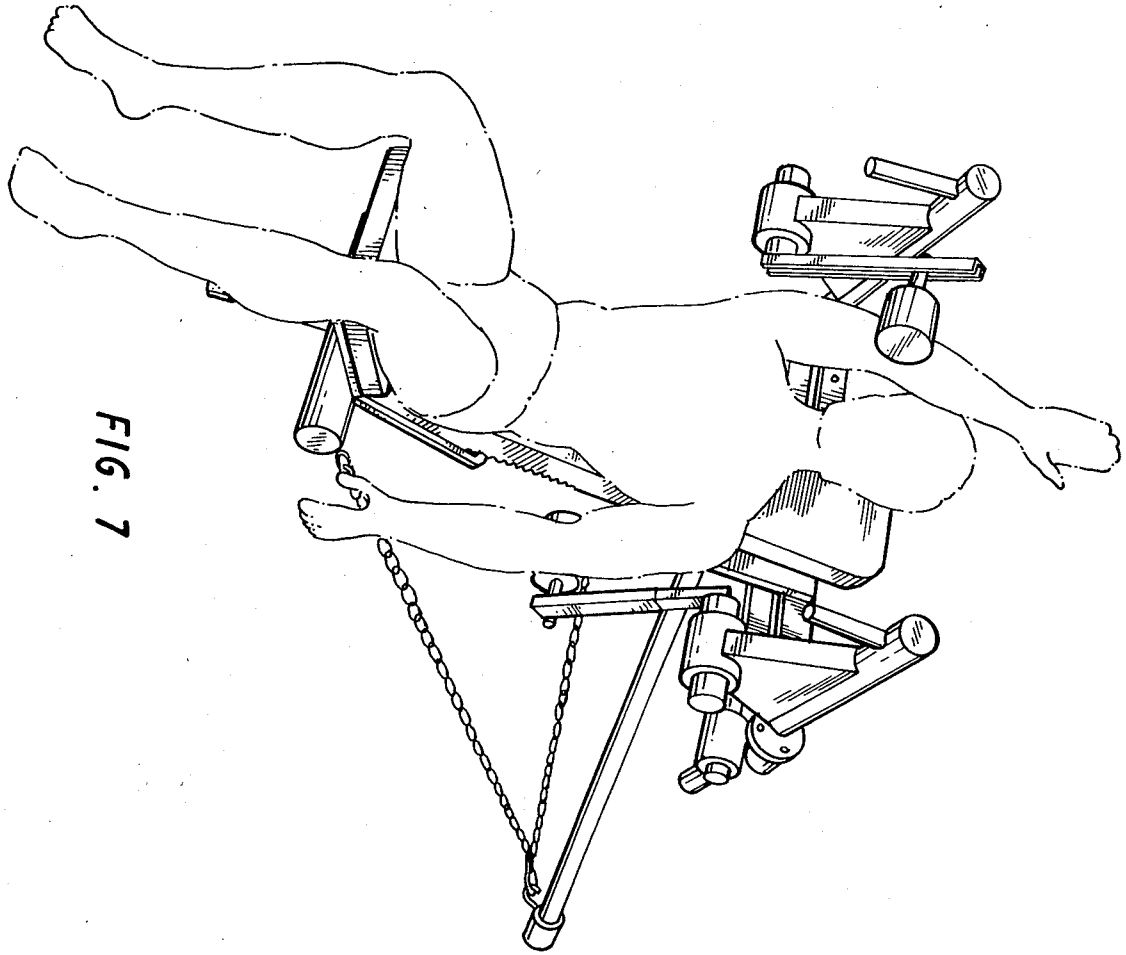
Figure 8:
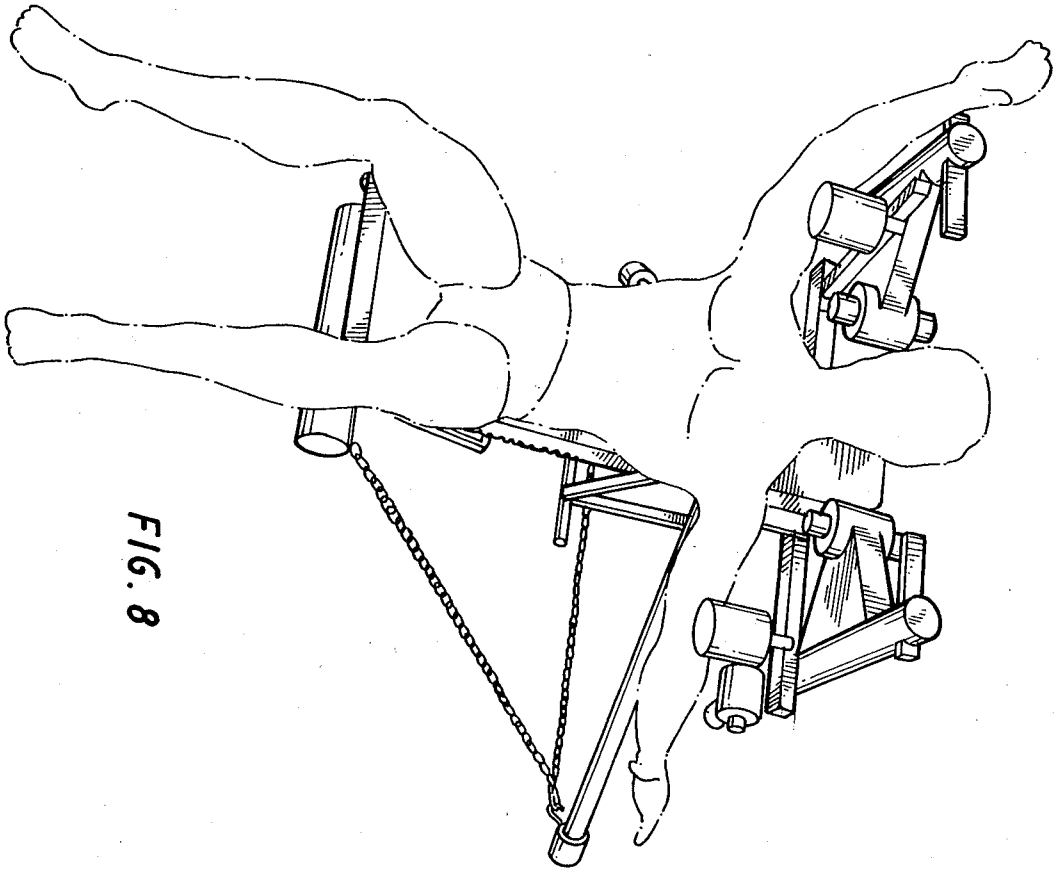
Figure 9:
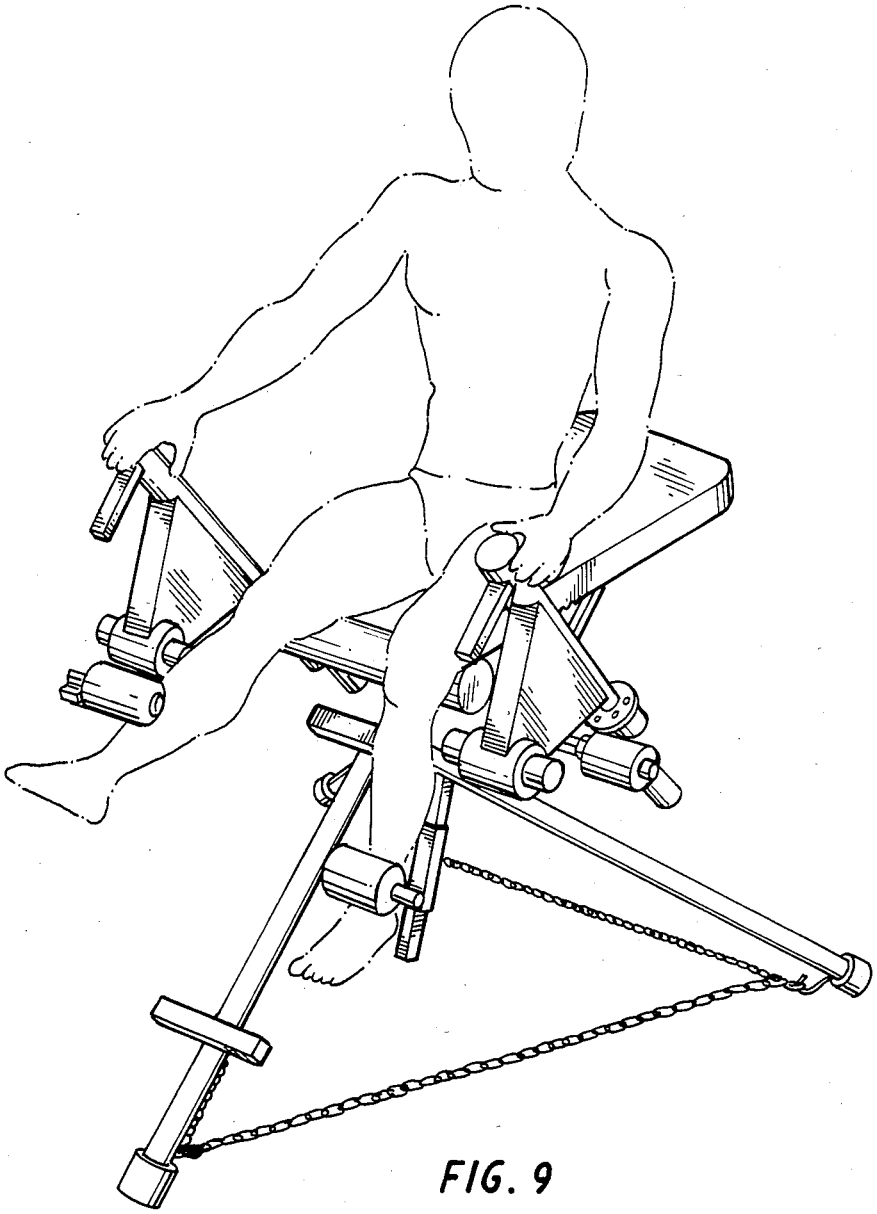
Figure 10:
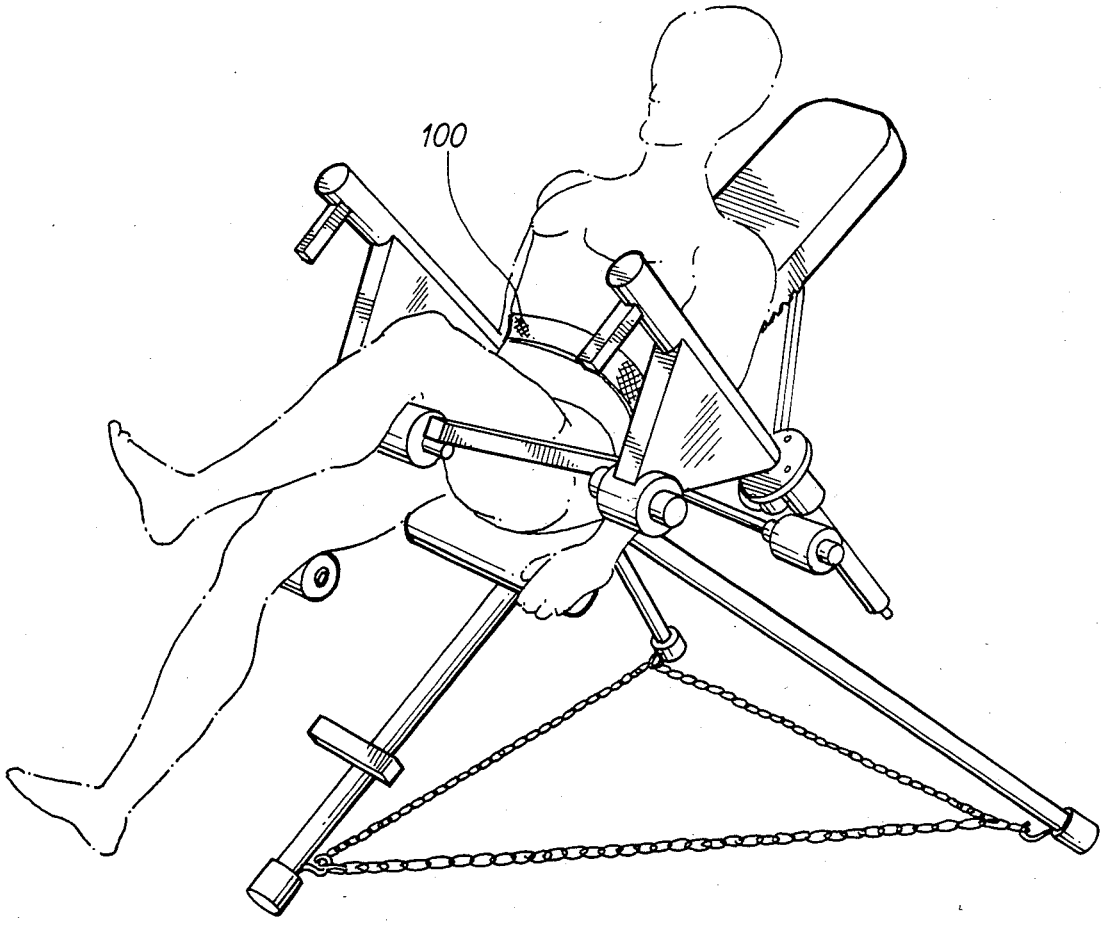

A typical exercise game is illustrated in FIG. 5, which includes dot and cross-hairs appearing on the screen of display unit 80. The dot is driven by the internal electronic memory in the microcomputer 64 to move horizontally across the screen of display 80. The cross-hairs, on the other hand, are driven by the user, as he swings the crank arms 38, 40 from one extreme position to the other, and the cross-hairs also move across the screen horizontally.

As the user pulls against the torque arms 38 and 40 with his body and limbs, the cross-hairs move up on the screen relative to the dot. Reducing his effort causes the cross-hairs to move down the screen relative to the dot. The cross-hairs move up or down in proportion to the force exerted, and left-right according to the position of the torque arms.

In order to carry out the exercise properly, the user must keep the cross-hairs on the dot as the dot moves horizontally across the screen. Each horizontal dot position corresponds to (1) an angular torque arm position and (2) a desired force level. The microcomputer 64 compares the actual, user force level as measured by the force sensor to the desired level stored in the microcomputer memory, and it generates an error signal. The microcomputer places the cross-hairs on the display, relative to the dot, based on the error signal. When the actual force is too high, the cross-hairs appear higher than the dot, as shown in representation (B); and when the actual force is too low, the cross-hairs are placed lower than the dot. Thus, the controller 64 causes the user to generate an appropriate force for each position, a dynamically varied force or resistance, to keep the dot centered in the cross-hairs, as shown in representation (A). Additionally, if the cross-hairs lead or trail the dot in their horizontal travel, as shown in representation (C) then the exercise "pace" needs to be slowed down or picked up. The microcomputer 64 also controls this important element of pacing, as well as resistance.

The particular display of FIG. 5 represents but one possible display, and a variety of other displays may be used to assure that the user performs the exercise properly, and to create incentives for the user.

An important feature of the exerciser of the invention is the ability of the microcomputer 64 readily to tailor the routines. In large measure this advantage accrues because there are no weights to set or change. The internal force/position algorithm may be instantaneously changed or modified electronically. Simply identifying the exercise by a key input on keyboard 84 can vary the algorithm controlling the exercise. The exerciser of the invention easily adapts to account for human differences such as sex, age, size, physical condition or intended end result. This ease of changing the exercise routine by varying the electronic algorithm makes possible other adaptive exercise benefits.

An example of this is a progressive resistance reduction as an exercise proceeds. A program of this nature recognizes the reduction in muscle capacity as the muscle fatigues. This heavy-to-light routine is used in advanced weight training in the prior art, but it requires three men to accomplish the program and a large selection of weights.

Rather than arbitrarily selecting an average "force/-position curve" for all to exercise to, the exercise apparatus of the invention can be caused to "read" what a particular user can pull throughout one exercise cycle. It can then use this personal standard to govern future exercise cycles.

The microcomputer 64 may also be used to adapt an exercise routine for an individual user from session-to-session. It can be programmed automatically to increment the demands of routines or increment them based on performance. Small increments and many changes are no problem since they only represent a change in a number held in the microcomputer memory, and do not involve different physical weights.

The exerciser of the invention utilizes a free-standing stand 30 in the illustrated embodiment which is held in place by the user's weight. The apparatus has an advantage over many prior art exercising devices in that it need not be attached to the floor or walls. Moreover, the entire unit in the illustrated embodiment may be readily folded up into a compact, easy to lift, portable package, which may be stored in a closet or under a bed, when not in use. The apparatus is ideal for home or apartment use, since no special rooms are required and no location need be dedicated exclusively to the apparatus.

The apparatus is designed so that the crank arms 38 and 40 may be rotated about three axes which converge on a single point in space. This design feature is important in minimizing the number and complexity of adjustments which must be made to provide full body exercise.

As mentioned above, the design of the apparatus of the invention permits the crank arms 38, 40 to rotate about three axes which converge on a single focus point in space. As also mentioned, this design feature is important for minimizing the number and complexity of the adjustments which must be made to provide full body exercise, For upper torso/arm exercise the focus point in space is located inside the shoulder at its pivot. A simple rotation of the force/torque assemblies 32 and 34 about their support point on stand 30 allows the upper torso to be stressed and exercised about three axes, or more if necessary. A setting for shoulder width and seat height is only made once for each user. A minimum of six exercises are performed on the upper body.

The back rest/seat elements 43, 45 can be easily positioned about the focus point in space to bring the legs, buttocks and lower back into an appropriate position to be exercised. Likewise, a simple adjustment of the back rest/seat elements and rotation of the force/torque assemblies allow the biceps/triceps to be exercised.

The invention provides, therefore, an improved exerciser which is ideal for use at home, but which also has institutional applications, especially in high schools and colleges, and the like, which cannot afford a complete complement of "Nautilus" type machines The construction of the present invention provides the benefits of a room equipped with Nautilus-type machines, with many fewer stations and at a fraction of the cost.

The particular stand 30 shown in the illustrated embodiment utilizes the floor plane, chain 31, and the three legs 33 to form a tetrahedron for supporting the mechanical working elements and the user up off the floor. The tetrahedron stand represents a stable, cost-effective, threedimensional structure, and it also provides for easy folding and erecting.

Although a particular embodiment of the invention has been shown and described, modifications may be made. It is intended in the claims to cover the modifications which come within the true spirit and scope of the invention.

What is claimed is:

1. Exercising apparatus including: a stand; first and second coupling units mounted on said stand displaced from one another along a horizontal axis, each of said coupling units being angularly adjustable about at least two axes to a multiplicity of positions to adapt the apparatus to a variety of different exercises; a rotatable shaft extending along said horizontal axis between said first and second coupling units and connected thereto; first and second crank arms respectively connected to said first and second coupling units, said first coupling unit being constructed so that rotation of said first crank arm in one direction exerts a torque on said one end of said shaft to cause said shaft to rotate in one direction, and said second coupling unit being constructed so that rotation of said second crank arm in said one direction exerts an opposite torque on the other end of said shaft to cause said shaft to rotate in the opposite direction.

2. The exercising apparatus defined in claim 1, in which said coupling units comprise respective first and second gear trains coupled to opposite ends of said rotatable shaft, and in which said first and second crank arms are connected to respective ones of said gear trains.

3. The exercising apparatus defined in claim 1, and which includes electrical sensing means connected to one of said coupling units for producing electrical signals indicating the angular rotation of the crank arms from a reference position and for indicating the torque exerted on the rotatable shaft by the crank arm.

4. The exercising apparatus defined in claim 2, and which includes electrical sensing means coupled to said first gear train in said first coupling unit for producing electrical signals indicating the angular rotation of the crank arms from a reference position and for indicating the torque exerted on the rotatable shaft by the crank arm.

5. The exercising apparatus defined in claim 4, and which includes microcomputer means electrically connected to said sensing means for processing the electrical signals from said sensing means, and a video display unit electrically connected to said microcomputer means.

6. The exercising apparatus defined in claim 5, and which includes programming means coupled to said microcomputer means for inputing predetermined data into the microcomputer means to cause the video display unit to exhibit predetermined information, at least a portion of which is under the control of the user of the apparatus.

7. The exercising apparatus defined in claim 5, and which includes audio reproducing means electrically connected to said microcomputer means.

8. The exercising apparatus defined in claim 2, and which includes a back rest/bench pivotally coupled at one end of the stand between the first and second coupling units and rotatable about a horizontal axis to predetermined angular positions.

9. The exercising apparatus defined in claim 2, and which includes a seat adapted to be mounted on said stand between said first and second coupling units.

10. The exercising apparatus defined in claim 1, in which said first and second coupling units are slidable along a horizontal axis to adapt the apparatus to varying user body widths.

11. The exercising apparatus defined in claim 10, in which each of said coupling units includes a stub shaft extending along said last-mentioned horizontal axis, and said apparatus includes a hollow shaft mounted on said stand for slidably receiving the stub shaft in coaxial relationship therewith.

12. The exercising apparatus defined in claim 2, in which said first gear train includes a slidable rack, a pair of offset gears coupling the first crank arm to the rack and a further gear coupling the rack to one end of the shaft, and said second gear train includes a slidable rack, three of said gears coupling the second crank arm to the last-named rack, and a further gear coupling the last-named rack to the other end of the shaft.

13. The exercising apparatus defined in claim 12, in which each of said coupling units includes a rod rotatably mounted on said stand for slidably supporting said rack.

* * * * *